US005943727A

United States Patent [19]

Freer

[11] Patent Number: 5,943,727

[45] Date of Patent: Aug. 31, 1999

[54] FOLDABLE CLEANING IMPLEMENT

[76] Inventor: David Freer, 619 18th St., Virginia Beach, Va. 23451

[21] Appl. No.: 08/971,219

[22] Filed: Nov. 14, 1997

[51] Int. Cl.[6] ..... A46B 9/10

[52] U.S. Cl. ..... 15/144.1; 15/145; 15/172; 15/176.2; 15/203; 15/228; 16/115

[58] Field of Search ..... 15/144.1, 144.2, 15/144.3, 144.4, 145, 159.1, 172, 176.2, 244.2, 228, 201, 203; 403/100, 102, 117; 16/115

[56] References Cited

U.S. PATENT DOCUMENTS

| | | | |
|---|---|---|---|
| 286,804 | 10/1983 | Fowler | 15/203 |
| 597,873 | 1/1898 | Beiderhase | 15/203 |
| 1,555,630 | 9/1925 | Brock | 15/203 |
| 1,623,672 | 4/1927 | Gould | 15/228 |
| 2,171,444 | 8/1939 | Frank | 15/172 |
| 2,443,233 | 6/1948 | Filardo | 15/144.1 |
| 2,493,329 | 1/1950 | Wirth | 15/171 |
| 2,744,275 | 5/1956 | Geltner | 15/144.3 |
| 2,802,230 | 8/1957 | Maddox | 15/144.1 |
| 3,296,643 | 1/1967 | Fortune | 15/201 |
| 3,358,313 | 12/1967 | Grimes, Sr. | 15/231 |
| 3,380,767 | 4/1968 | Barth | 403/102 |
| 4,082,186 | 4/1978 | Chirumbolo | 15/145 |
| 4,354,511 | 10/1982 | Kjaer et al. | 15/201 |
| 4,845,800 | 7/1989 | Pederson et al. | 15/228 |
| 5,121,520 | 6/1992 | Brice | 15/172 |
| 5,548,864 | 8/1996 | Vosbikian et al. | 15/257.7 |
| 5,566,418 | 10/1996 | Steffen et al. | 15/244.1 |
| 5,746,533 | 5/1998 | Schmidt | 403/102 |

*Primary Examiner*—Mark Spisich
*Assistant Examiner*—Theresa T. Snider
*Attorney, Agent, or Firm*—MacMillan, Sobanski & Todd, LLC

[57] ABSTRACT

A foldable cleaning implement is foldable into a compact form for ease in transporting and storing. The cleaning implement has a handle and a head. The handle may be formed from a plurality of segments coupled together by foldable elements. The head is attached to the handle, preferably by a pivotable or universal joint, and is formed from segments which are displaceable relative to one another so as to selectively be oriented in a coplanar relationship relative to one another, angular disposed relative to one another, and in opposing directions relative to one another.

17 Claims, 7 Drawing Sheets

FOLDABLE CLEANING IMPLEMENT

BACKGROUND OF THE INVENTION

1. Field of the Invention

The present invention relates generally to a foldable cleaning implement and more specifically to a cleaning implement which folds into a small compact cleaning implement and which comprises a bilaterally folding head which alternatively provides a planar cleaning surface, angularly disposed cleaning surfaces, and opposingly directed cleaning surfaces.

2. Description of the Prior Art

Cleaning implements, such as brooms, mops and the like, are well known in the prior art. The continued use of such device today as cleaning implements has proven their usefulness to be a preferred, at times even over more sophisticated cleaning implements, such as the vacuum cleaners and the like. Vacuum cleaners may be considered more suitable for cleaning irregular surfaces, such as carpeted surfaces, but other cleaning implements remain to be a more desirable at least by some, especially when cleaning relatively smooth surfaces, or under certain conditions.

Brooms and mops are typically stored out of the way when not in use. The space required for storing such implements may range from a relative small space to a large space, depending on the size of the head, with exception to the handle, which generally ranges from 38–53 inches rendering the overall length of the broom or mop ranging from 48–55 inches. In residential structures, brooms and mops are typically stored in a garage or a closet, or concealed adjacent an article of furniture or appliance, such as between a wall and a hutch or refrigerator. In commercial establishments, cleaning implements are generally stored in a designated location. In fact, such a location is commonly referred to as a "broom closet."

Supporting a janitorial staff and keeping supplies and cleaning implements on hand can prove to be costly. With an ever growing focus on budget reduction, janitorial services have become a very popular alternative to the employment of a full-time janitor or janitorial staff. Janitorial services clean offices on a contract basis. Such services provide cleaning staffs which arrive at a location contracted to be cleaned. Cleaning of the subject location is generally scheduled on a periodic basis and the janitorial service is typically responsible for not only providing a competent and trustworthy cleaning staff but cleaning implements and supplies as well. With the demanding schedule placed on our work force today, and the relative low cost of the janitorial service, cleaning of residential establishments as well as commercial establishments has become quite popular.

A problem associated with providing a cleaning service is that of transporting the staff along with the cleaning implements and supplies. In order to provide an affordable service, the cost of staff, cleaning implement, supplies and transportation of the same has to be keep at a minimum. To reduce transportation expenses, janitorial services often transport their staff, cleaning implements and supplies in compact cars, making use of the passenger compartment for transporting the staff while the trunk compartment is used to transport the cleaning implements and supplies. Often the trunk space is limited, making it difficult to transport brooms, mops and mop buckets, vacuum cleaners, as well as other cleaning implements and supplies. This difficulty may be addressed by providing cleaning implements which may be broken down and stored in compact form, making more efficient use of space.

U.S. Pat. No. 597,873, issued Jan. 25, 1898, to George B. Beiderhase, discloses a foldable brush. U.S. Pat. No. 2,493,329, issued Jan. 3, 1950, to Anthony F. Worth, discloses a brush section pivotally connected to a handle. U.S. Pat. No. 2,802,230, issued Aug. 13, 1957, to Marshall J. Maddox, discloses a rotatable support mechanism for joining a handle to the work head on a mop, broom, brush, long-handled tool, or the like. U.S. Pat. No. 3,358,313, issued Dec. 19, 1967, to Roland S. Grimes, Sr., discloses a handle and a mop frame connected to the handle by a universal or pivotal joint. U.S. Pat. No. 2,443,233, issued Jun. 15, 1948, to Domenico Filardo, discloses a paint brush handle which may be assembled and disassembled to provide a handle of desired length. A paint brush is rigidly secured to the handle at an angle relative to the handle. U.S. Pat. No. 5,548,864, issued Aug. 27, 1996, to Peter Vosbikian et al., discloses tube hingedly attached to a dustpan. U.S. Pat. No. 5,566,418, issued Oct. 22, 1996,to David H. Steffen et al., discloses an extensible arm formed of telescopic and pivotal segments.

None of the above inventions and patents, taken either singly or in combination, is seen to describe the instant invention as claimed.

SUMMARY OF THE INVENTION

The present invention relates to a foldable cleaning implement which may be folded into a compact form for ease in transporting and storing. The cleaning implement comprises a handle and a head. The handle is formed from a plurality of segments coupled together by foldable elements. The head is attached to the handle preferably by a pivotable or universal joint and is formed from segments which are displaceable relative to one another so as to alternatively be oriented in a coplanar relationship relative to one another, angular disposed relative to one another, and in opposing directions relative to one another.

The instant invention overcomes problems associated with conventional cleaning implements that do not break down into small or compact forms in that it may be easily transported and occupies little storage space. Moreover, the segments forming the head may be oriented to provide two cleaning surfaces angularly disposed relative to one another for quickly and efficiently cleaning inside comers, such as those formed between walls, between walls and ceilings, and along the base of walls. In addition, the segments forming the head may be oriented to provide opposingly disposed cleaning surfaces for cleaning in close confines. This feature further enables the cleaning implement to be folded into even a smaller compact form, thus improving its ease in transportability and further reducing its storage space consumption. The pivotal connection between the handle and the head enables the user to gain greater leverage over the cleaning implement when in use regardless of the orientation of the segments of the head. It may also further improve the ability of the cleaning implement to be folded into a small compact.

Accordingly, it is a principal object of the invention to provide a foldable cleaning implement which is foldable into a compact form so as to be easily transported and stored.

It is another object of the invention to provide a cleaning implement having a head movably attached to a handle to permit the head to be displacable relative to handle.

It is yet another object of the invention to provide a cleaning implement having a head formed of segments which are displaceable relative to one another.

It is still another object of the invention that the segments of the head be releasably fixed relative to one another alternatively in a coplanar relationship, an angularly disposed relationship, and opposingly disposed relationship to one another.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
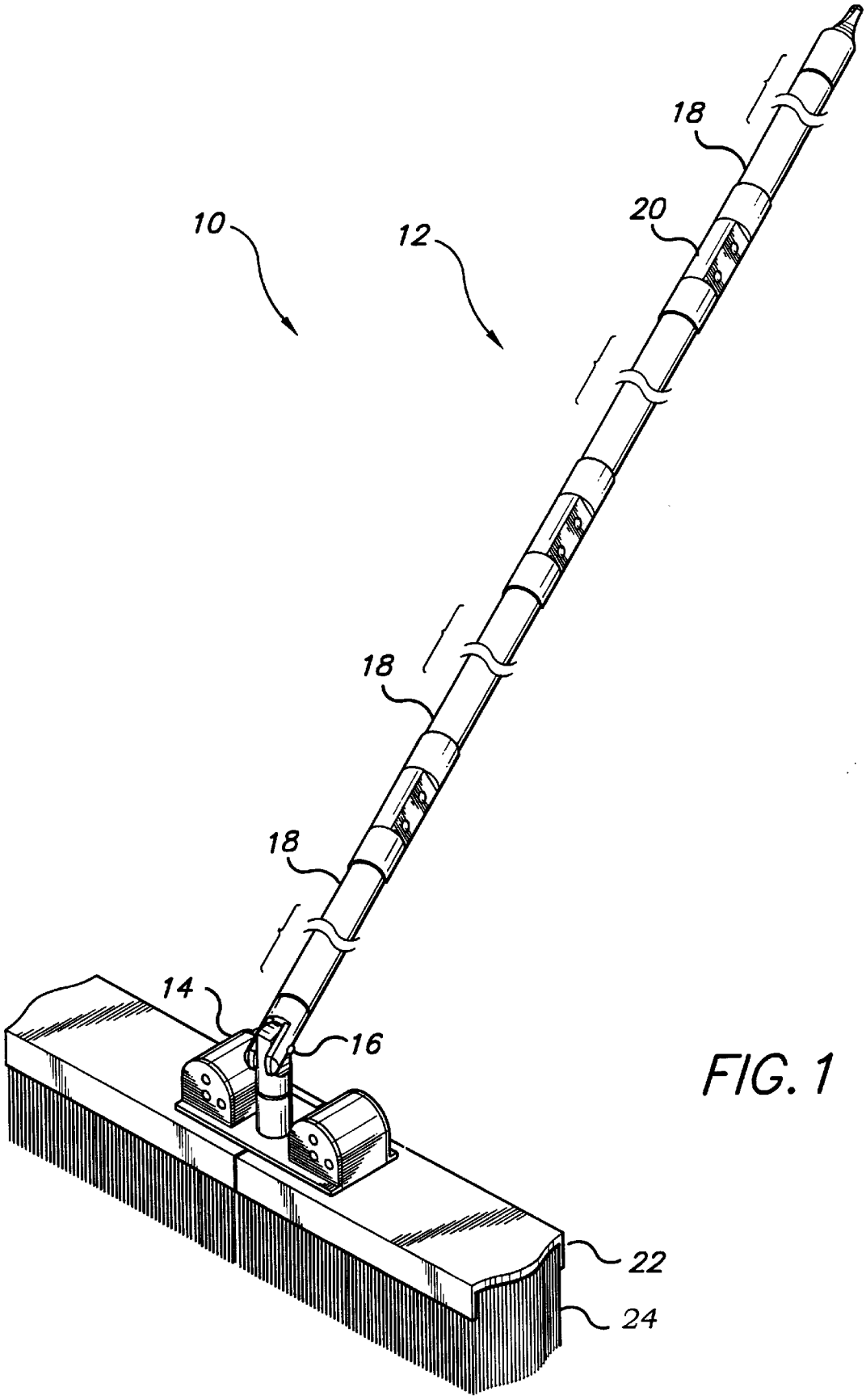
FIG. 1 is a perspective view of a foldable cleaning implement according to the instant invention.

The present invention, as shown in FIG. 1, is a foldable cleaning implement 10 comprising a foldable handle 12 and a head 14 connected to the handle 12. The handle 12 includes a plurality of segments 18. The segments 18 are connected together by foldable joints 20. The head 14 comprises a pair of displaceable planar segments 22. The planar segments 22 cooperate to provide a support surface for supporting a bifurcated cleaning element 24, such as the bifurcated bristle broom head shown, or a mop head (not shown). A pivotal or universal joint 16, such as the pivotal or universal joint 20 shown in FIGS. 1, 6 and 8 in U.S. Pat. No. 3,358,313, issued Dec. 19, 1967, Ronal S. Grimes, Sr., may be disposed intermediate the handle 12 and head 14 to provide greater leverage and control over the cleaning implement 10.

Figure 2:
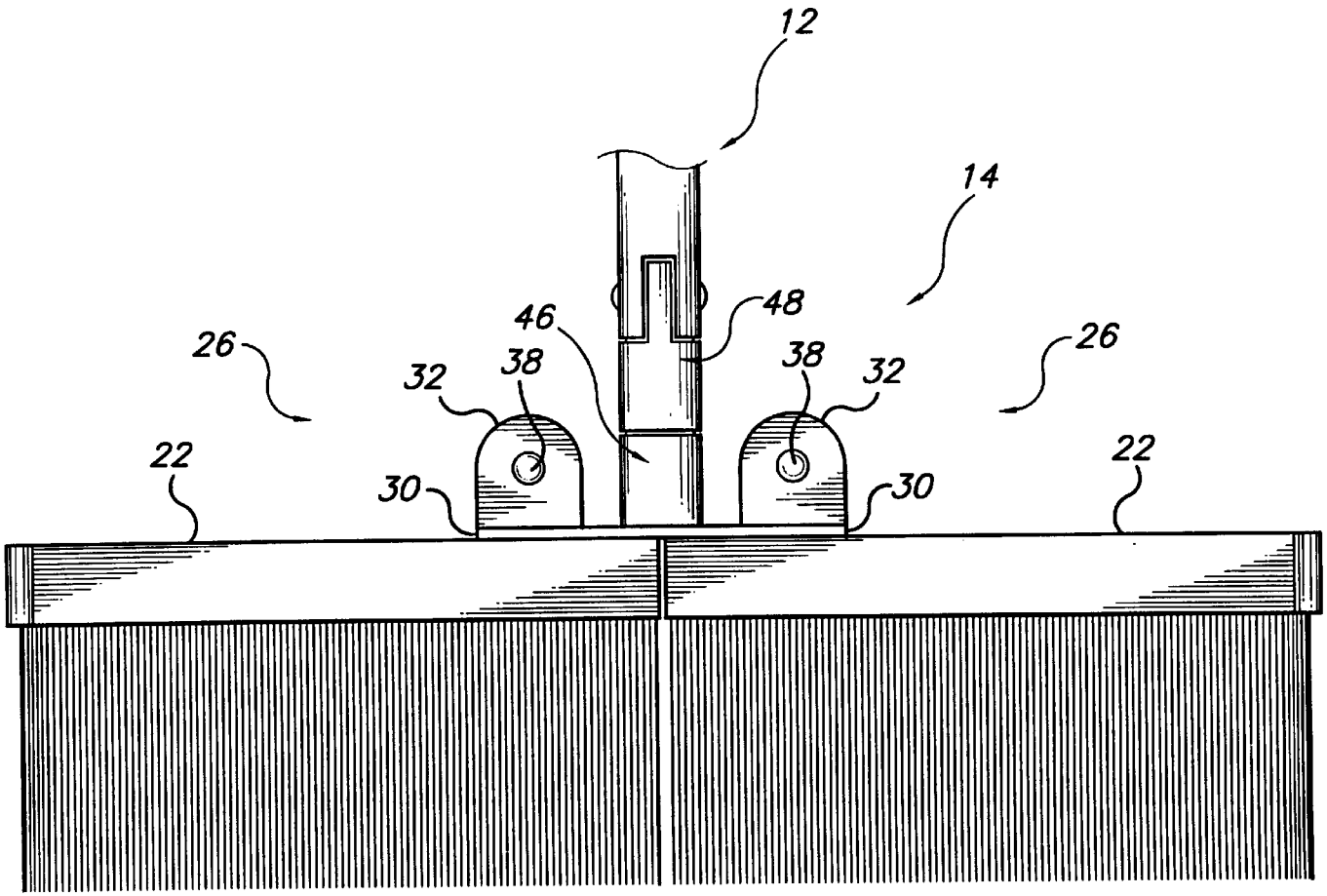
FIG. 2 is an enlarged elevational view of a segmented head for supporting a cleaning surface.
Figure 3:
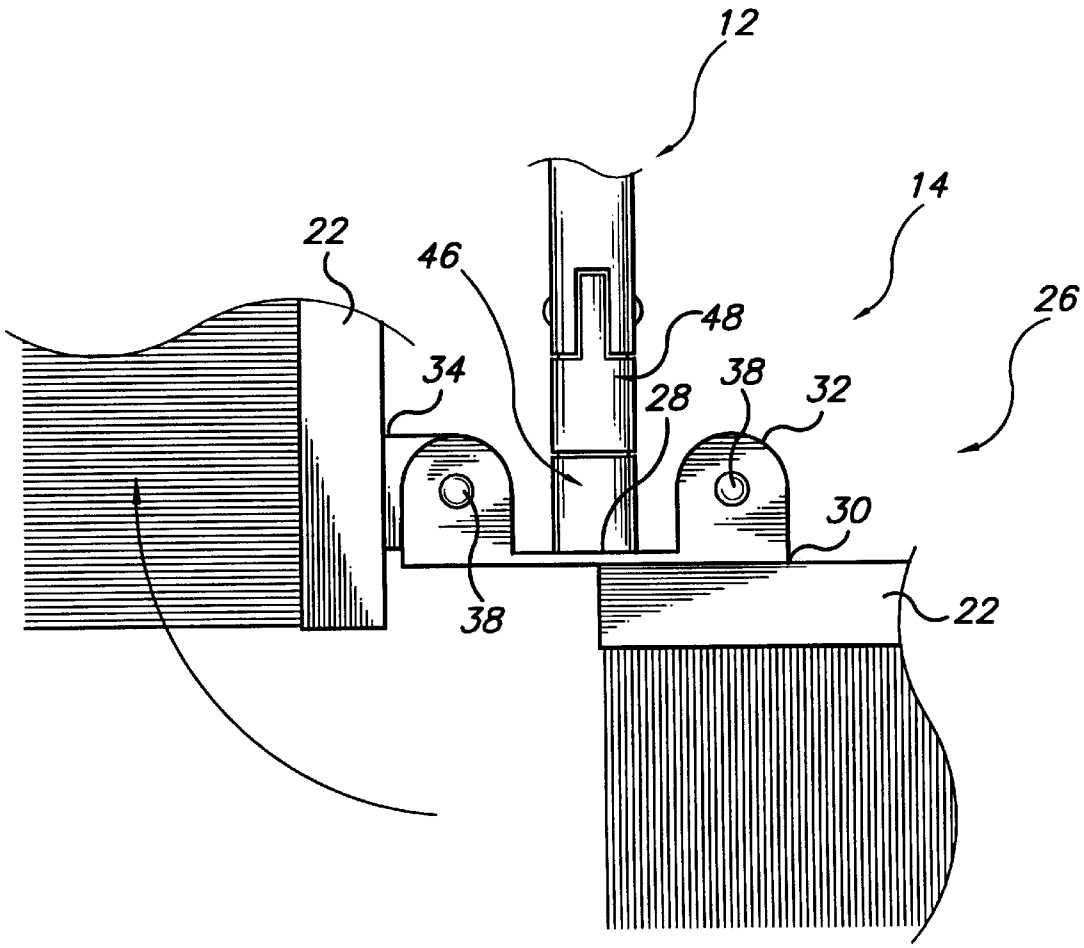
FIG. 3 is an enlarged elevational view of the segmented head shown in FIG. 2 further showing one of the segments displaced relative to the other so as to provide angularly disposed cleaning surfaces.
Figure 4:
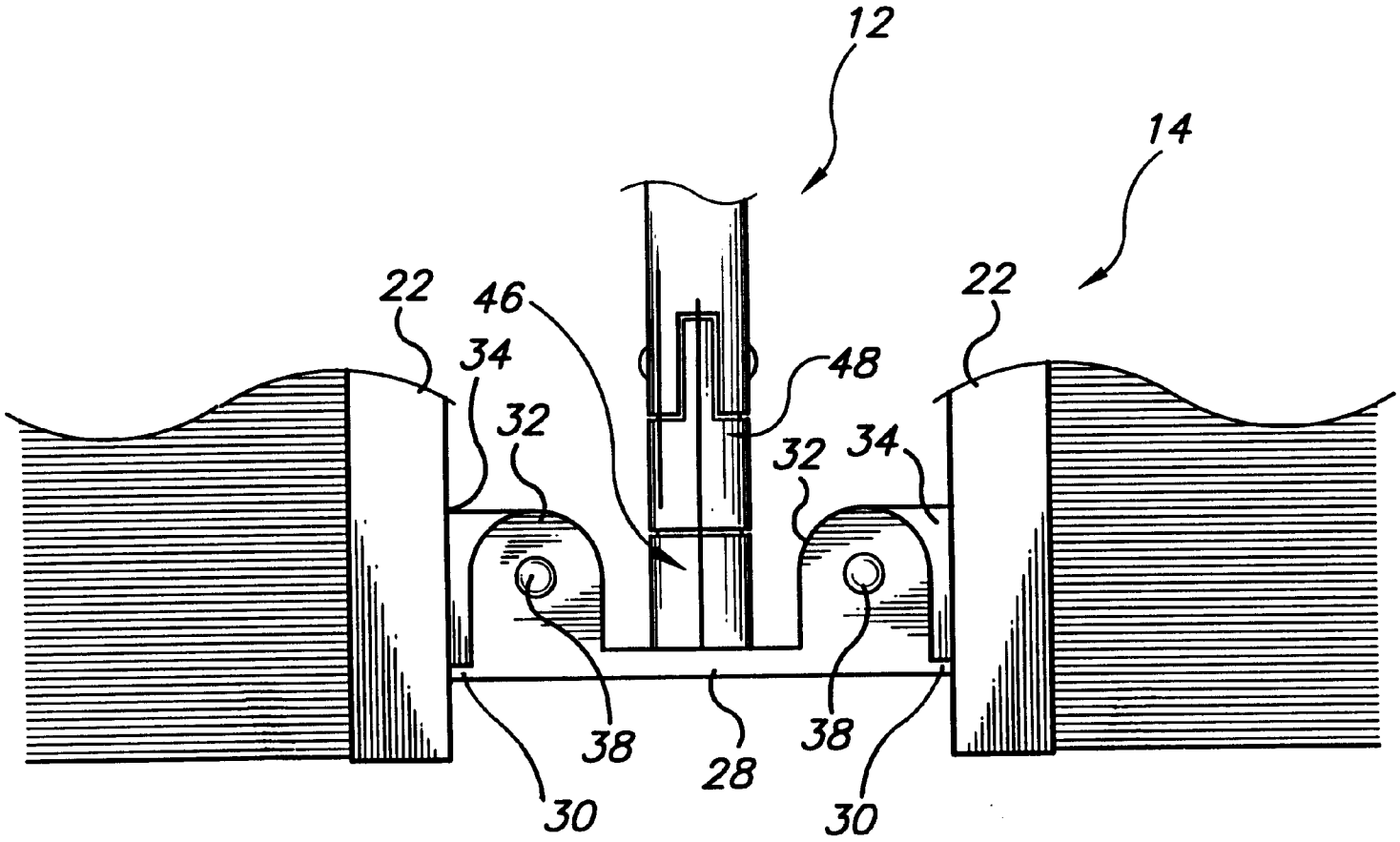
FIG. 4 is an enlarged elevational view of the segmented head shown in FIG. 2 further showing each of the segments displaced relative to the other so as to provide opposingly disposed cleaning surfaces.
Figure 6:
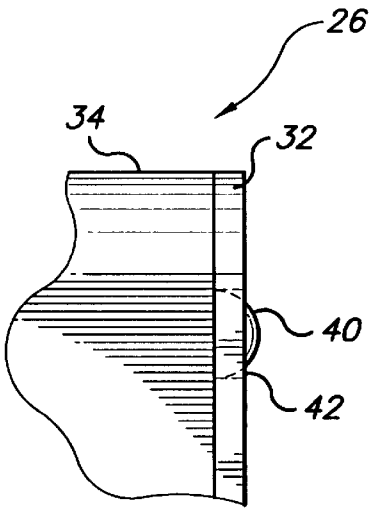
FIG. 6 is a sectional view of the pivotal element.
Figure 5:
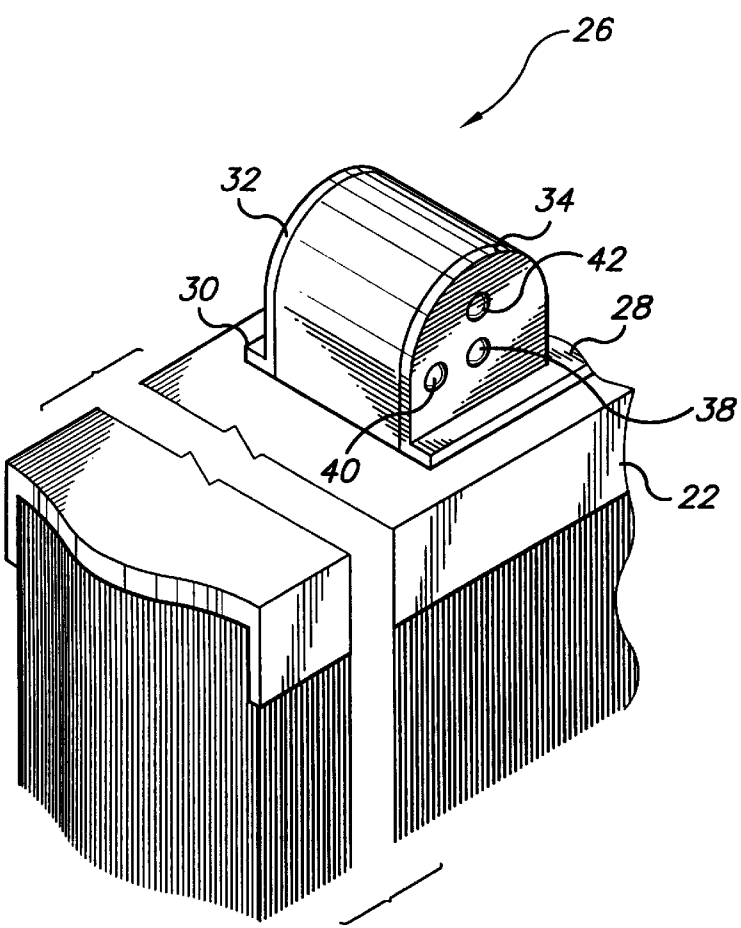
FIG. 5 is an enlarged elevational view of a pivotal element which permits the displacement of the segments of the head.

As shown in FIGS. 2 through 4, the planar segments 22 are displaceable relative to one another. This is accomplished through the employment of a pair of spaced apart pivotal arrangements 26. The pivotal arrangements 26 include guides 32 and matingly engageable elements 34, are bridged together by a laterally extending main structure 28. The main structure 28 has opposing ends 30. The opposing ends 30 include guides 32 for receiving mating elements 34. The guides 32 and mating elements 34 have coaligning holes (not shown) through which a coupling or pivot pin 38 passes. The pivot pin 38 pivotally engages the guides 32 and mating elements 34. As shown in FIGS. 5 and 6, the guides 32 may include reliefs 42 and the mating elements 34 may be provided with a catch element 40, such as a spring ball, which is selectively engageable with the reliefs 42 to retain the planar segments 22 in one of a number of predetermined positions. For example, one of the planar segments 22 is displaced by 90 degrees, as is shown in FIG. 3, forming a right angle with the planar segment 22. This configuration is well suited for cleaning in corners, such as where two adjoining walls meet, where the wall meets the ceilings, or at the base of the wall where the wall meets the floor. Alternatively, the other planar segment 22 may likewise be displaced by 90 degrees so that the cleaning surfaces are opposingly disposed, as is clearly shown in FIG. 4. This configuration is well suited for cleaning in close confines, such as between articles of furniture or appliances in close proximity with one another or in close proximity with a wall. It should be understood that the instant invention is not limited to the application of the pivotal arrangement 26 shown and that other pivotal arrangements which perform the same or a similar function may be utilized.

Referring back to FIGS. 6 and 5, the reliefs 44 shown are provided at the nine o'clock and twelve o'clock, and three o'clock and twelve o'clock positions. Alternatively, a single relief and a plurality of catch elements may be provided. It should be noted that the guides 32 and mating elements 34 may engage at different points or at a greater number of points, or positions, than those shown in the drawings.

Now, with reference back to FIGS. 2 through 4, the head 14 is coupled to the handle 12 by a coupling element, such as the coupling element shown in FIGS. 2 and 3. This coupling element includes a male element 45 having an external thread and a female element 46 having an internal thread. The female element 46 is in the form of an internally threaded socket centrally located on the laterally extending main structure 28 of the head 14. The male counterpart 48 is defined by an externally threaded portion of the distal end 48 of the handle 12. The distal end 48 of the handle 12 is threadably engageable with the socket 46 associated with the head 14 to permit the handle 12 to be releasably coupled to the head 14.

Figure 7:
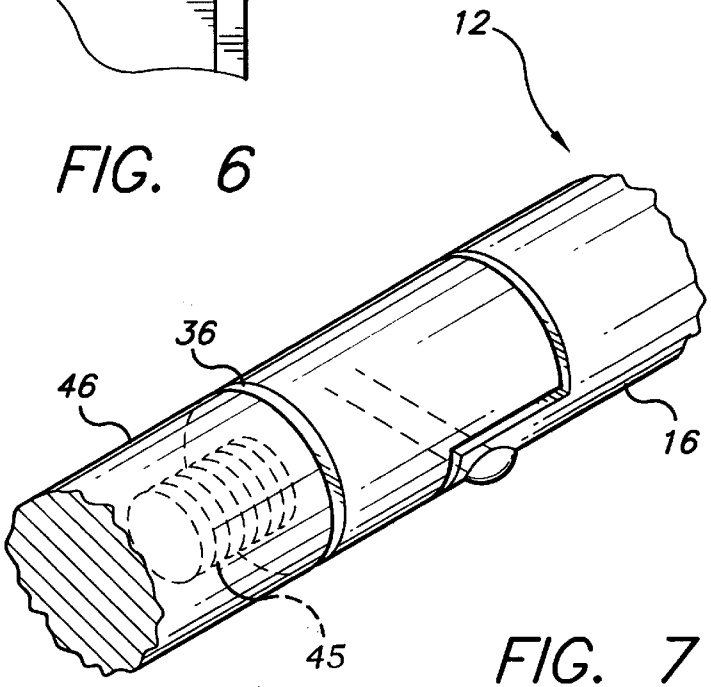
FIG. 7 is a perspective view of a pivotal joint for coupling the head to the handle.

As set forth above, a pivotal or universal joint 16, such as that shown in FIG. 7, may be integral with the distal end 48 of the handle 12. Furthermore, a swivel 36 may be provided. The pivotal joint 16 and swivel 36 permit the handle 12 to be displaced relative to the head 14 which allows the user to exert greater leverage upon and control over the cleaning implement 10. The pivotal joint 16 and swivel 36 may be free-moving elements or may be selectively displaceable over a range of determined positions.

Figure 9:
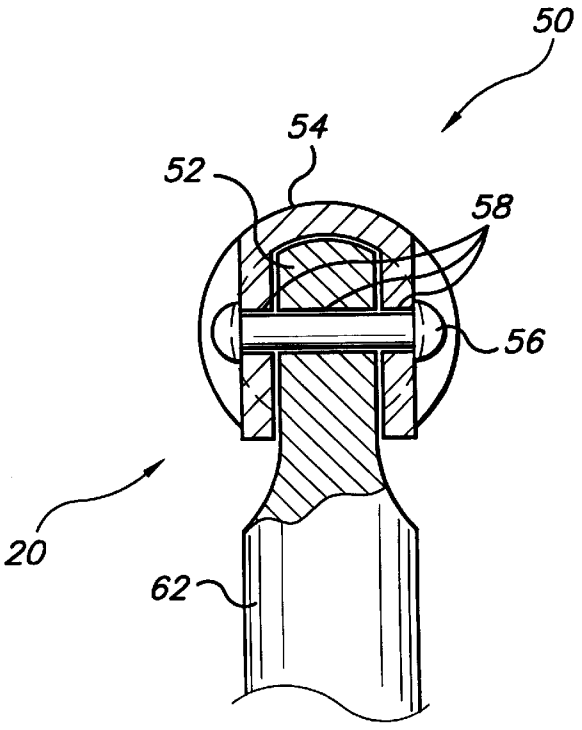
FIG. 9 is an enlarged sectional view of the foldable joint.
Figure 8:
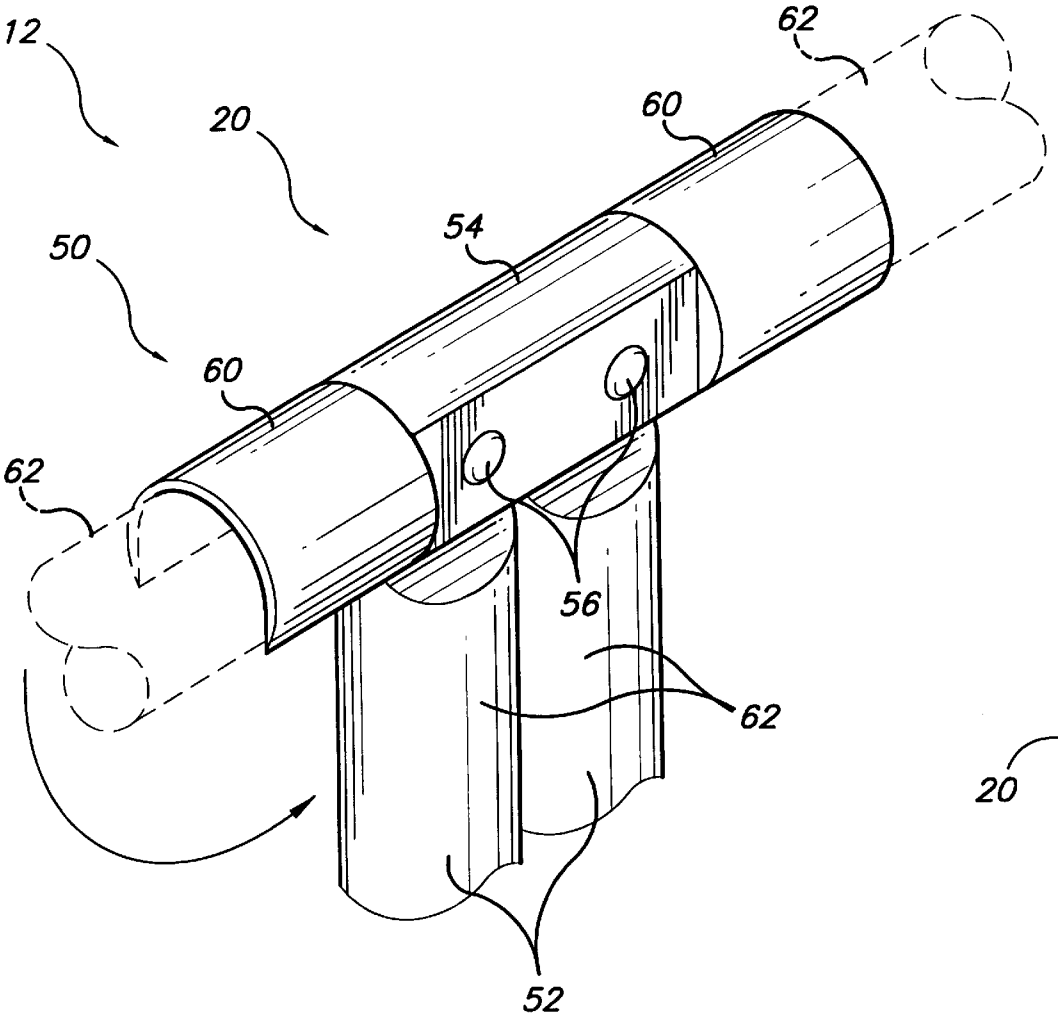
FIG. 8 is an enlarged perspective view of a foldable joint which permits the handle to be folded in a compact form.

Now referring to FIGS. 8 and 9, a folding joint 20 is shown including a link 50 pivotally connecting adjoining ends 52 of segments 18 of the handle 12. The link 50 is provided with a centrally located fold forming a channel 54 for receiving the adjoining ends 52. The adjoining ends 52 are slightly flattened to substantially conform to the configuration of the channel 54 of the link 50. The adjoining ends 52 and the channel 54 are provided with coaligning holes 58 pass. A pivot pin 56 is received through the coaligning holes 58 to pivotally connect the adjoining ends 52 and the channel 54 and thus retain the adjoining ends 52 within the channel 54. The link 50 further has opposing ends 60 and the segments 18 of the handle 12 further include engaging portions 62 proximate the adjoining ends 52 of the segments 18 of the handle 12. The opposing ends 60 are structured to form clips for receiving the engaging portions 62 of the handle segments 18. The clips 60 are configured to substantially compliment and conform to the engaging portions 62 of the handle segments 18. Moreover, the clips 60 are dimensioned to snugly receive or frictionally engage the engaging portions 62 of the handle segments 18. It is preferable that the central channel 54 be sufficiently rigid to provide adequate support for the adjoining ends 52 connected thereto and that the clips 60 be sufficiently resilient to expand upon inserting the respective engaging portions 62 of the handle segments 18 therein. In this way, the engaging portions 62 may be forcibly inserted into clips 60.

Figure 10:
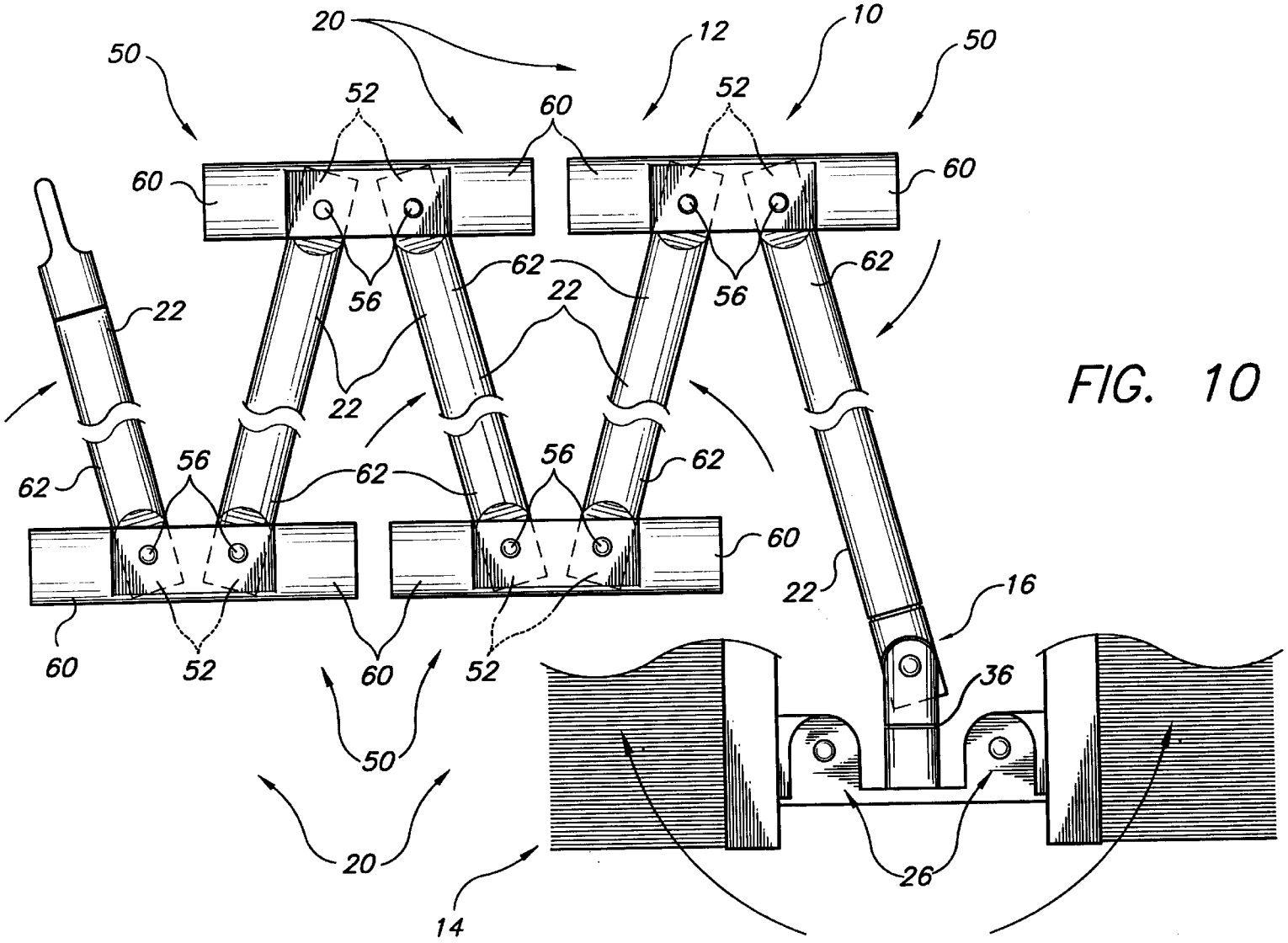
FIG. 10 is an elevational view the cleaning implement shown in FIG. 1 further shown folded in a compact form for ease in transporting and storage.

As is shown in FIG. 10, a cleaning implement 10 according to the instant invention may be folded into a small compact cleaning implement by folding the handle 12 and further by folding the head 14. A cleaning implement 10 according to the instant invention in its compact form may be easily transported, such in the trunk compartment of a motor vehicle. Moreover, a cleaning implement 10 according to the instant invention may be easily stored in its compact form, such as in a drawer, on a closet or pantry shelf, or in the glove compartment of a motor vehicle.

It is to be understood that the present invention is not limited to the sole embodiment described above, but encompasses any and all embodiments within the scope of the following claims.

I claim:

1. A cleaning implement, comprising:

a handle;

a bifurcated head connectable to said handle, said head including:

a main structure having opposing ends, said main structure being connectable to said handle, at least one pivotal arrangement disposed at each one of said opposing ends, each one of said pivotal arrangements comprising a catch element for selectively engaging said pivotal arrangement in a predetermined position, said catch element comprising a spring ball and relief configuration, said spring ball being selectively engageable with said relief, and a segment pivotally connected to said main structure by each of said pivotal arrangements; and a cleaning element supported by each of said segments.

2. The cleaning implement according to claim 1, wherein said cleaning element comprises a bristle configuration.

3. The cleaning implement according to claim 1, wherein said cleaning element comprises an absorbent structure.

4. The cleaning implement according to claim 1, wherein said handle is structured and configured to be foldable.

5. The cleaning implement according to claim 1, wherein said handle has a male element and said handle has a female element integral therewith, said male and female elements being engageable with one another to connect said handle to said head.

6. The cleaning implement according to claim 5, wherein said male element comprises an external thread, and said female element comprises an internal thread, said external thread of said male element being matingly engageable with said internal thread of said female element to releasably connect said head to said handle.

7. The cleaning implement according to claim 1, further including a pivotal joint intermediate said head and said handle.

8. The cleaning implement according to claim 7, wherein said pivotal joint is structured and configured to be selectively engaged in a predetermined position.

9. The cleaning implement according to claim 7, wherein said pivotal joint is structured and configured to be selectively engaged in a plurality of predetermined positions.

10. A cleaning implement, comprising:

a handle;

a bifurcated head connectable to said handle, said head including:

a main structure having opposing ends, said main structure being connectable to said handle, at least one pivotal arrangement disposed at each one of said opposing ends, each one of said pivotal arrangements being structured and configured to be selectively engaged in a plurality of predetermined positions, each one of said plurality of pivotal arrangements further being structured and configured to include a catch element comprising a spring ball and relief configuration for selectively engaging said pivotal arrangement in a plurality of predetermined positions, and a segment pivotally connected to said main structure by each of said pivotal arrangements; and a cleaning element supported by each of said segments.

11. The cleaning implement according to claim 10, wherein said handle is structured and configured to be foldable.

12. A cleaning implement, comprising:

a handle;

a bifurcated head connectable to said handle by a coupling element, said head comprising:

a main structure having opposing ends;

a plurality of pivotal arrangements, at least one of said plurality of pivotal arrangements being disposed at each one of said opposing ends, each one of said plurality of pivotal arrangements comprises a catch element for selectively engaging said pivotal arrangements in a predetermined position, said catch element comprising a spring ball and relief configuration, said spring ball being selectively engageable with said relief; and a plurality of segments pivotally connected to said main structure by said plurality of pivotal arrangements; and a bifurcated cleaning element supported by said head.

13. The cleaning implement according to claim 12, wherein said handle is structured and configured to be foldable.

14. A cleaning implement, comprising:

a handle;

a bifurcated head connectable to said handle by a coupling element, said head comprising:

a main structure having opposing ends;

a plurality of pivotal arrangements, at least one of said plurality of pivotal arrangements being disposed at each one of said opposing ends, each one of said plurality of pivotal arrangements being structured and configured to include a catch element comprising a spring ball and relief configuration for selectively engaging said pivotal arrangement in a plurality of predetermined positions; and a plurality of segments pivotally connected to said main structure by said plurality of pivotal arrangements; and a bifurcated cleaning element supported by said head.

15. The cleaning implement according to claim 14, wherein said cleaning element comprises a bristle configuration.

16. The cleaning implement according to claim 14, wherein said cleaning element comprises an absorbent structure.

17. The cleaning implement according to claim 14, wherein said handle is structured and configured to be foldable.

* * * * *